US007522865B2

(12) United States Patent
Hasdai et al.

(10) Patent No.: US 7,522,865 B2
(45) Date of Patent: Apr. 21, 2009

(54) TONER DEVELOPMENT UNIT

(75) Inventors: Guy Hasdai, Rehovot (IL); Sharon Nagler, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 389 days.

(21) Appl. No.: 11/396,666

(22) Filed: Apr. 3, 2006

(65) Prior Publication Data

US 2007/0231013 A1 Oct. 4, 2007

(51) Int. Cl.
*G03G 15/10* (2006.01)

(52) U.S. Cl. ..... 399/241; 399/119; 399/237

(58) Field of Classification Search ..... 399/119, 399/237, 241
See application file for complete search history.

(56) References Cited

U.S. PATENT DOCUMENTS 3,908,037 A * 9/1975 Bickmore ..... 399/258
4,504,138 A * 3/1985 Kuehnle et al. ..... 399/240
4,707,112 A * 11/1987 Hartmann ..... 399/241
4,985,732 A * 1/1991 Landa et al. ..... 399/238
5,724,629 A * 3/1998 Iino et al. ..... 399/245
6,108,513 A 8/2000 Landa et al.
6,141,517 A * 10/2000 Kuramochi et al. ..... 399/237
7,292,810 B2 * 11/2007 Tanner et al. ..... 399/237
2004/0175206 A1 * 9/2004 Landa et al. ..... 399/237
2006/0153597 A1 * 7/2006 Guzman et al. ..... 399/237

FOREIGN PATENT DOCUMENTS

JP 60252379 A * 12/1985
JP 03279986 A * 12/1991
JP 10282795 A * 10/1998

OTHER PUBLICATIONS

English Abstract JP60252379A.*
English Abstract JP10282795A.*
English Abstract JP03279986A.*

* cited by examiner

*Primary Examiner*—David M Gray
*Assistant Examiner*—Ryan D Walsh

(57) ABSTRACT

A toner development unit for an image forming apparatus including a roller and an electrode adjacent thereto, the electrode having an arcuate extent adjacent to a portion of a surface of the roller to define a toner application gap therebetween, the roller being adapted to rotate in a given direction wherein the gap diverges in the direction of rotation of the roller relative to the electrode.

15 Claims, 7 Drawing Sheets

TONER DEVELOPMENT UNIT

FIELD OF THE INVENTION

The present invention relates to improvements in or relating to image forming apparatus.

BACKGROUND OF THE INVENTION

Printing has many problems. The print quality phenomenon known as flow streaks exists. Flow streaks can be produced by image forming apparatus such as printers (e.g. xerographic printers), photocopiers and fax machines. Flow streaks can be seen on a printed substrate, such as a piece of paper, as lines in the direction of travel of the substrate through the image forming apparatus. Typically these lines are not straight but look more like flow lines of a fluid, and are generally fainter than the printed matter on the substrate. In the more severe cases the flow lines can be seen quite frequently at various levels of intensity and appear as different grey levels on the printed substrate.

No real solutions have been proposed to this problem but attempts have been made to reduce the severity of the flow streaks by changing the working conditions of the image forming apparatus. These include increasing the ink density, increasing the flow of ink, keeping the level of ink in an ink reservoir above a certain point, and also modifying the return of the ink to the reservoir to reduce the formation of bubbles.

BRIEF DESCRIPTION OF THE DRAWINGS

The present invention will be apparent from the following description of a preferred embodiment shown by way of example only in the accompanying drawings, of which:—

DETAILED DESCRIPTION OF EMBODIMENTS OF THE INVENTION

An example of the kind of printer to which, in one embodiment, the invention relates is that described in U.S. Pat. No. 6,108,513. The reader is directed to read that now and its contents are incorporated by reference.

Figure 1:
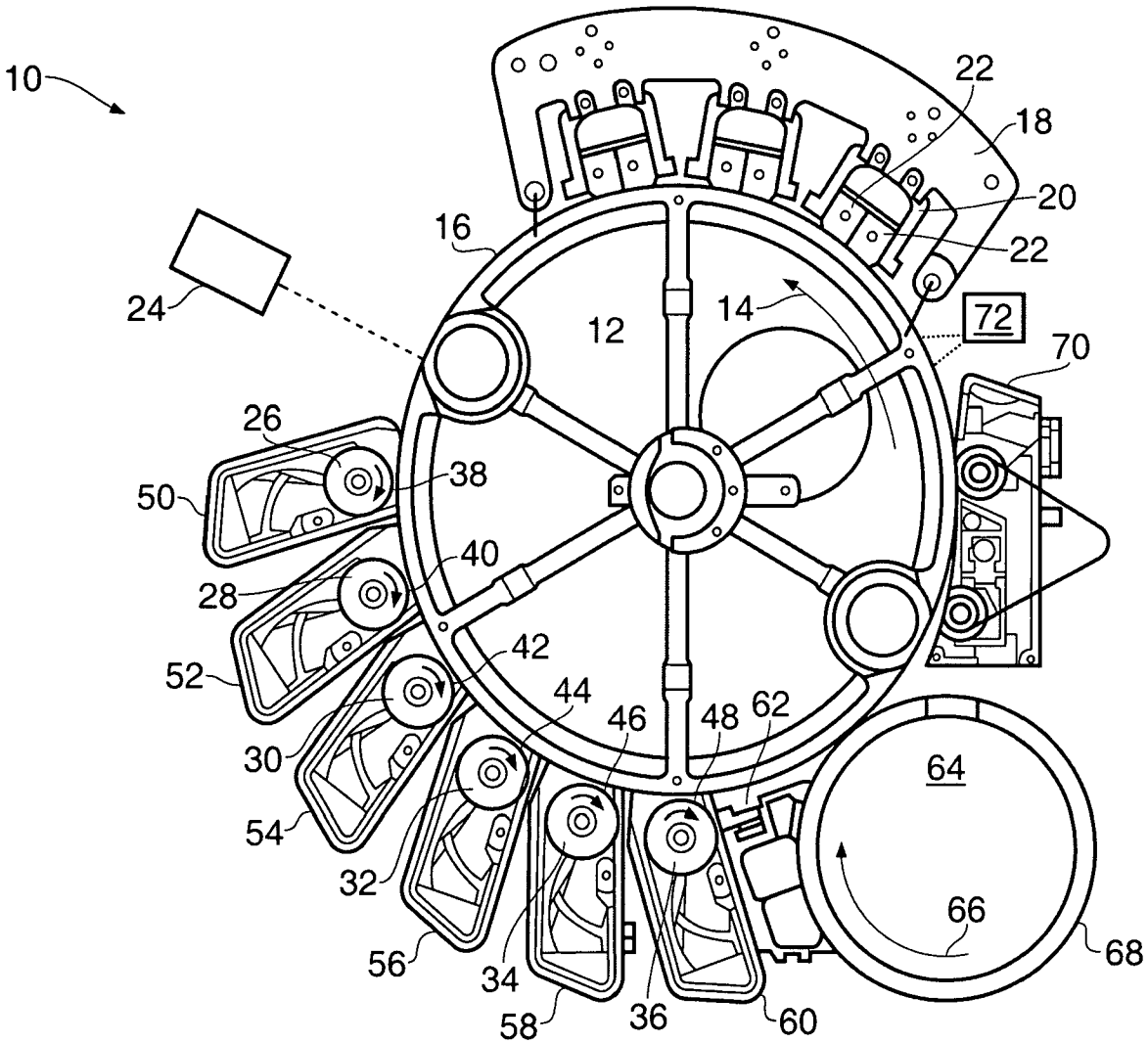
FIG. 1 is a diagram of an image forming apparatus shown in section according to an embodiment of the present invention.

FIG. 1 of the drawings of this present patent application shows an image forming apparatus, such as a laser printer, generally designated 10. The apparatus 10 includes a drum 12 arranged to rotate in a direction shown by arrow 14 and has a photoconductive surface 16. When the apparatus 10 is operated the drum 12 rotates and the photoconductive surface 16 is charged by a charger 18 to a generally uniform pre-determined voltage, typically a negative voltage of the order of 1000 Volts. The charger 18 may be any type of charger 18 known in the art, such as a corotron, a scorotron or a roller. In one embodiment of the invention the charger 18 comprises three double scorotrons, each having a housing 20, and two corona wire segments 22.

Although desirably, particularly for high-speed imaging, the voltage between wires 22 and surface 16 should be as high as possible, the actually obtained voltage is generally not higher than 7000-7500 Volts, and typically 7300 Volts, due to discharging between the wires 22 and the housing 20.

Rotation of the drum 12 brings the charged photoconductive surface 16 into image receiving relationship with an exposure means 24, such as a light source. The exposure means 24 may be a laser scanner in the case of a printer, or the projection of an image in the case of a photocopier. In one embodiment of the present invention, the light source is a modulated laser beam scanning apparatus, or other laser imaging apparatus such as is known in the art.

The exposure means 24 forms a desired electrostatic image on the charged photoconductive surface 16 by selectively discharging portions of the photoconductive surface 16. The image portions are at a first voltage and the background portions are at a second voltage. In one embodiment the discharged portions have a negative voltage of less than about 100 Volts.

Continued rotation of drum 16 brings the charged photoconductive surface 16, having the electrostatic image, into operative engagement with a series of six developer rollers 26, 28, 30, 32, 34, 36 having respective surfaces 38, 40, 42, 44, 46, 48. The developer rollers 26, 28, 30, 32, 34, 36 are for printing of different colours. Each developer roller 26, 28, 30, 32, 34, 36 forms part of a respective developer assembly 50, 52, 54, 56, 58, 60. One of the developer assemblies is more fully described below with reference to FIGS. 2 to 6. Each developer assembly 50, 52, 54, 56, 58, 60 is removable from the apparatus 10 should they be required to be replaced due to a malfunction. The developer rollers 26, 28, 30, 32, 34, 36 rotate in a direction opposite to that of drum 12, such that there is substantially no relative motion between their respective surfaces at the point of contact. In one embodiment the surfaces 38, 40, 42, 44, 46, 48 of developer rollers 26, 28, 30, 32, 34, 36 are made of a soft polyurethane material made more electrically conductive by the inclusion of conducting additives, while the core of each developer roller 26, 28, 30, 32, 34, 36 may be made of any suitable electrically conductive material. Alternatively, the drum 12 may be formed of a relatively resilient material, and in such case the surfaces 38, 40, 42, 44, 46, 48 of developer rollers 26, 28, 30, 32, 34, 36 may be composed of either a rigid or a compliant material. In one embodiment the developer rollers 26, 28, 30, 32, 34, 36 are charged to a negative voltage of approximately 300-600 Volts.

As described below, the surfaces 38, 40, 42, 44, 46, 48 are coated with a very thin layer of concentrated liquid ink, or toner, containing 20-50% charged toner particles. The layer of toner is between 5 and 30 μm thick. The developer rollers 26, 28, 30, 32, 34, 36 are themselves charged to a voltage that is intermediate the voltage of the charged and discharged areas on the photoconductive surface 16. The liquid toner for each developer assembly 50, 52, 54, 56, 58, 60 is stored in a respective toner reservoir one of which is shown at 108 and is more fully described below with reference to FIG. 2. Each toner reservoir 108 is readily replaceable in the form of a removable cartridge should the liquid toner run low.

Referring to FIG. 1 when surfaces 38, 40, 42, 44, 46, 48 of developer rollers 26, 28, 30, 32, 34, 36 having the layer of liquid toner concentrate thereon are engaged with photoconductive surface 16 of drum 12, the difference in voltage between each developer roller 26, 28, 30, 32, 34, 36 and the photoconductive surface 16 causes the selective transfer of the layer of toner particles to the photoconductive surface 16. This causes the desired electrostatic image to be developed on the photoconductive surface 16. Depending on the choice of toner charge polarity and the use of a "write-white" or "write-black" system, the layer of toner particles will be selectively attracted to either the charged or discharged areas of photoconductive surface 16, and the remaining portions of the toner layer will continue to adhere to surfaces 38, 40, 42, 44, 46, 48 21 of developer rollers 26, 28, 30, 32, 34, 36.

It will be appreciated that each of the different developer assemblies 50 to 60 may be used to print a different colour of ink or toner.

The present invention is described in the context of a BID (Binary Image Development) system in which the concentrated layer of liquid toner is completely transferred to the photoconductor surface 16 during development. However, it should be appreciated that the present invention is also compatible with a partial BID system in which only a portion of the thickness of the concentrated toner layer is transferred to surface 16 by appropriately adjusting the development voltages. A partial BID system of this type is described in PCT publication WO 94/16364, the disclosure of which is incorporated herein by reference.

Downstream of development assemblies 50, 52, 54, 56, 58, 60 is a background discharge device 62. The discharge device 62 is operative to flood the photoconductor surface 16 with light which discharges the voltage remaining on photoconductor surface 16. This reduces electrical breakdown and improves subsequent transfer of the image. Operation of such a device in a write black system is described in U.S. Pat. No. 5,280,326, the disclosure of which is incorporated herein by reference.

The electrostatic image developed by means of the process described above can then be directly transferred to a desired substrate in a manner well known in the art. Alternatively, as in the embodiment of the invention shown in FIG. 1, the developed image is transferred to the desired substrate via an intermediate transfer member 64, such as a drum or belt, in operative engagement with photoconductive surface 16 of drum 12 having the developed image. The intermediate transfer member 64 rotates in a sense opposite to that of the photoconductive surface 16, as shown by arrow 66, providing substantially zero relative motion between their respective surfaces at the point of image transfer.

The intermediate transfer member 64 is operative for receiving the developed image onto an image bearing surface 68 thereof from the photoconductive surface 16, and for transferring this image to a final substrate (not shown), such as paper. The final substrate is urged against the image bearing surface 68 of the image transfer member 64. The transfer of the developed image from image transfer member 64 to the final substrate is electrostatically assisted which is adapted to counteract the electrostatic attraction of the developed image to the image transfer member 64.

Disposed internally of the intermediate transfer member 64 there may, or may not, be provided a heater (not shown), to heat the intermediate transfer member 64 as is known in the art. Transfer of the developed image to the intermediate transfer member 64 is aided by providing electrification of the intermediate transfer member 64 to provide an electric field between the intermediate transfer member 64 and the image areas of the photoconductive surface 16. The intermediate transfer member 64 is maintained at a suitable voltage and temperature for electrostatic transfer of the image thereto from the photoconductive surface 16. The arrangements of such an intermediate transfer member 64 are known to those skilled in the art.

The developed image may be comprised of a plurality of different colours which are successively deposited on the photoconductive surface 16. The colour image is then transferred to intermediate transfer member 64. Subsequent images in different colours are sequentially transferred in alignment with the previous image onto intermediate transfer member 64. When all of the desired images have been transferred, the complete multi-colour image is transferred from transfer member 64 to the substrate.

In another embodiment each single colour image can be separately transferred to the substrate via the intermediate transfer member 64. Alternatively, the intermediate transfer member 64 can be omitted and the developed single colour images transferred sequentially from the photoconductive surface 16 of the drum 12 to the substrate.

Following the transfer of the developed image to the substrate or to the intermediate transfer member 64, the photoconductive surface 16 engages a cleaning station 70 which may be any cleaning station known in the art. A lamp 72 completes the imaging cycle by removing any residual charge from the previous image from the photoconductive surface 16 if necessary. In some embodiments of the present invention the lamp 72 may be omitted and surface 16 is discharged only by discharge device 62.

Figure 2:
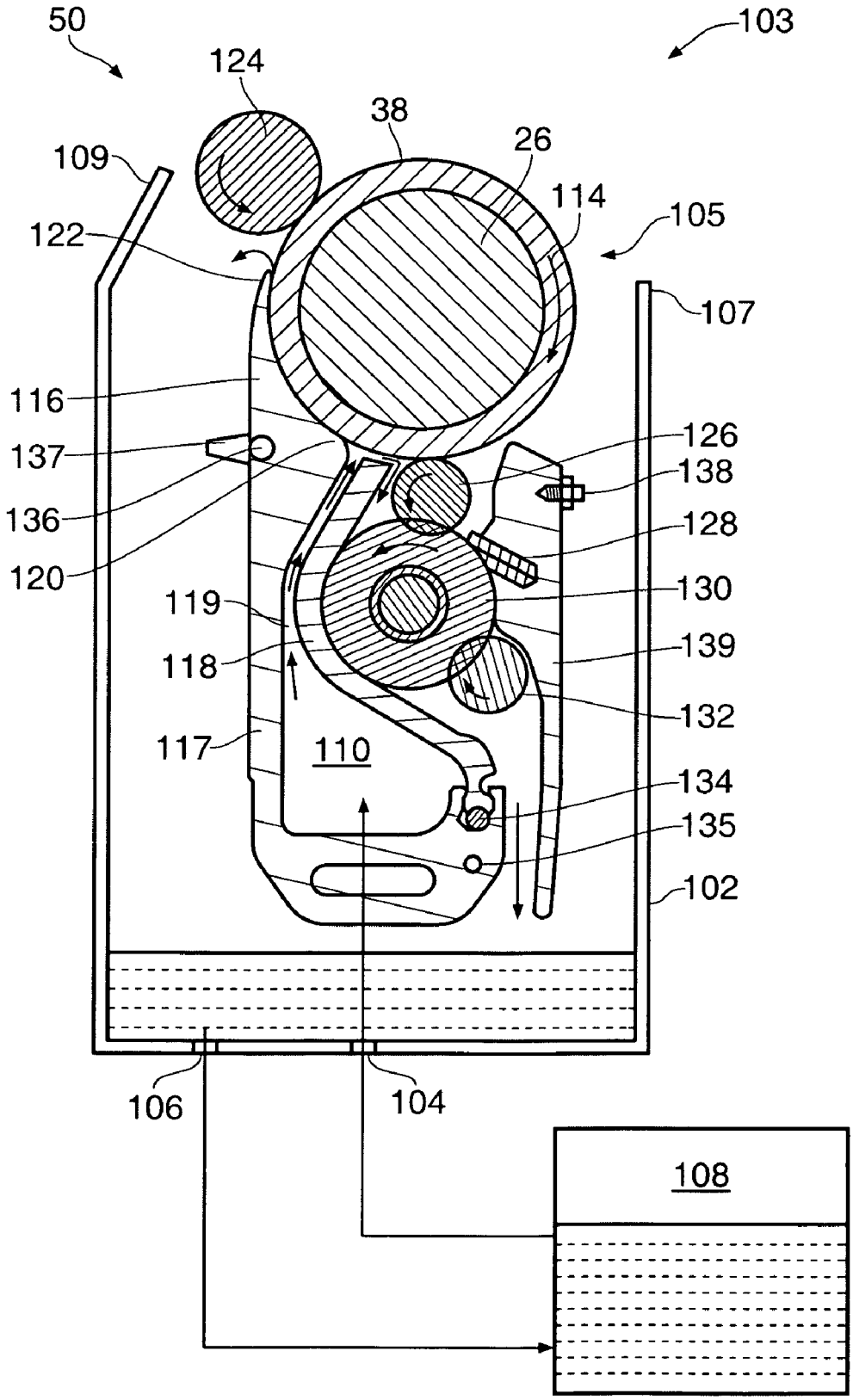
FIG. 2 is a diagram of a developer assembly shown in section according to an embodiment of the present invention.

In FIG. 2 there is shown one of the developer assemblies of FIG. 1, generally designated 50, which has a developer roller 26. The developer assembly 50 may be a removable cartridge described below with reference to FIGS. 5 and 6, which is insertable into the image forming apparatus 10 and removable therefrom should a malfunction with the developer assembly 50 occur.

As shown in FIG. 2, the developer assembly 50 includes a housing 102 having a toner inlet 104 and a toner outlet 106 each of which is associated with a toner reservoir 108. The housing 102 contains a BID engine 103 which is described in more detail below with reference to FIGS. 4 to 6. In FIG. 2, fresh liquid toner from the reservoir 108 is pumped via the toner inlet 104 into an inlet chamber 110 of the developer assembly 50 by a pump (not shown). Toner which is returned from the BID engine 103 is returned from housing 102 to the reservoir 108 via the toner outlet 106. In multi-colour image forming apparatus systems, as shown in FIG. 1 the developer assemblies 50, 52, 54, 56, 58, 60 are associated with individual reservoirs (not shown), each reservoir typically containing a different colour toner.

In one embodiment of the invention the developer roller 26 has a small diameter, such as about 15 centimeters. In one embodiment, the developer roller 26 includes a metal core, having a diameter of approximately 31 millimeters, coated with a 4.5 millimeter layer of polyurethane having a Shore hardness of 35. The polyurethane layer is coated with a four to five micrometer layer of a conductive lacquer which also extends along the sides of roller 26 so as to be electrically connected to the metal core.

The surface of roller 26 protrudes from an opening 105 of housing 102 such that, when the assembly 50 is installed in the image forming apparatus 10, the surface 38 of the roller 26 is in close proximity with the photoconductive surface 16 of the drum 12 such that the surface 38 of the roller and the photoconductive surface 16 are about 5-10 mm apart. The opening 105 is between wall 107 and 109 of the housing. When the apparatus 10 is activated, the surface 38 of the roller 26 is electrically charged to a negative voltage of 300-600 Volts, for example −400 Volts, and is rotated in the direction indicated by arrow 114. A layer of highly concentrated liquid toner is deposited onto the surface 38 of the roller 26, as described below and then an actuator (not shown) moves the BID engine 103 so that the surface 38 of the roller 26 is in contact with the photoconductive surface 16 of the drum 12. Thus, the roller 26 functions as a developer roller with regard to electrostatic images formed on the photoconductive surface 16 of the drum 10, as described above with reference to FIG. 1.

In FIG. 2 the pressurized toner (pressurised by the pump not shown) received via the inlet 104 is deposited on the developer roller 26 by a depositing electrode 116 made of aluminium which forms one wall 117 of the inlet chamber 110, at an upper end 119 of the inlet chamber 110. The opposite wall 118 of the inlet chamber 110 is formed of the same material as the electrode 116, and is juxtaposed with the surface 38 at a distance of approximately 0.5 millimeters from the wall 118. A gasket 134 is located between the depositing electrode 116 and the wall 118. The electrode 116, which is charged to a negative voltage of 900-2000 Volts, for example—1400 Volts, has a curved surface 117 which forms an arcuate extent juxtaposed with a portion of the surface 38 of the developer roller 26. The arcuate surface 117 is juxtaposed with the surface 38 over an angle of about 60° of the developer roller 26. The arcuate extent of the electrode 116 has a leading edge 120 and a trailing edge 122 which is defined relative to the direction of rotation of the developer roller 26. The leading edge 120 is at a distance of approximately 400 μm from the surface 38, and the trailing edge 122 is at a distance of approximately 550 μm from the surface 38. The gap between the arcuate extent of the electrode 116 and the surface 38 increases or diverges linearly between the leading edge 120 and the trailing edge 122. By "linearly" is meant the rate of increase of the gap, i.e. the rate of divergence is substantially constant over the curved extent of the gap, or at least over a sub-part of the curved extent of the gap. This constant rate of increase may be over the full length of the electrode, or at least a sub-part thereof. It will be appreciated that if the angle of the arcuate extent is larger, the increase in size of the divergent gap is more gradual. The angular extent of the divergent gap can vary but in many embodiments it is at least 10° and in most it is at least 20°. Generally it will be between 50° and 70°.

In another embodiment the gap between the arcuate extent of the electrode and the surface 38 diverges non-linearly around the arc between the leading edge 120 and the trailing edge 122. By "non-linearly" is meant the rate of increase of the gap, or the rate of divergence increases.

Figure 3:
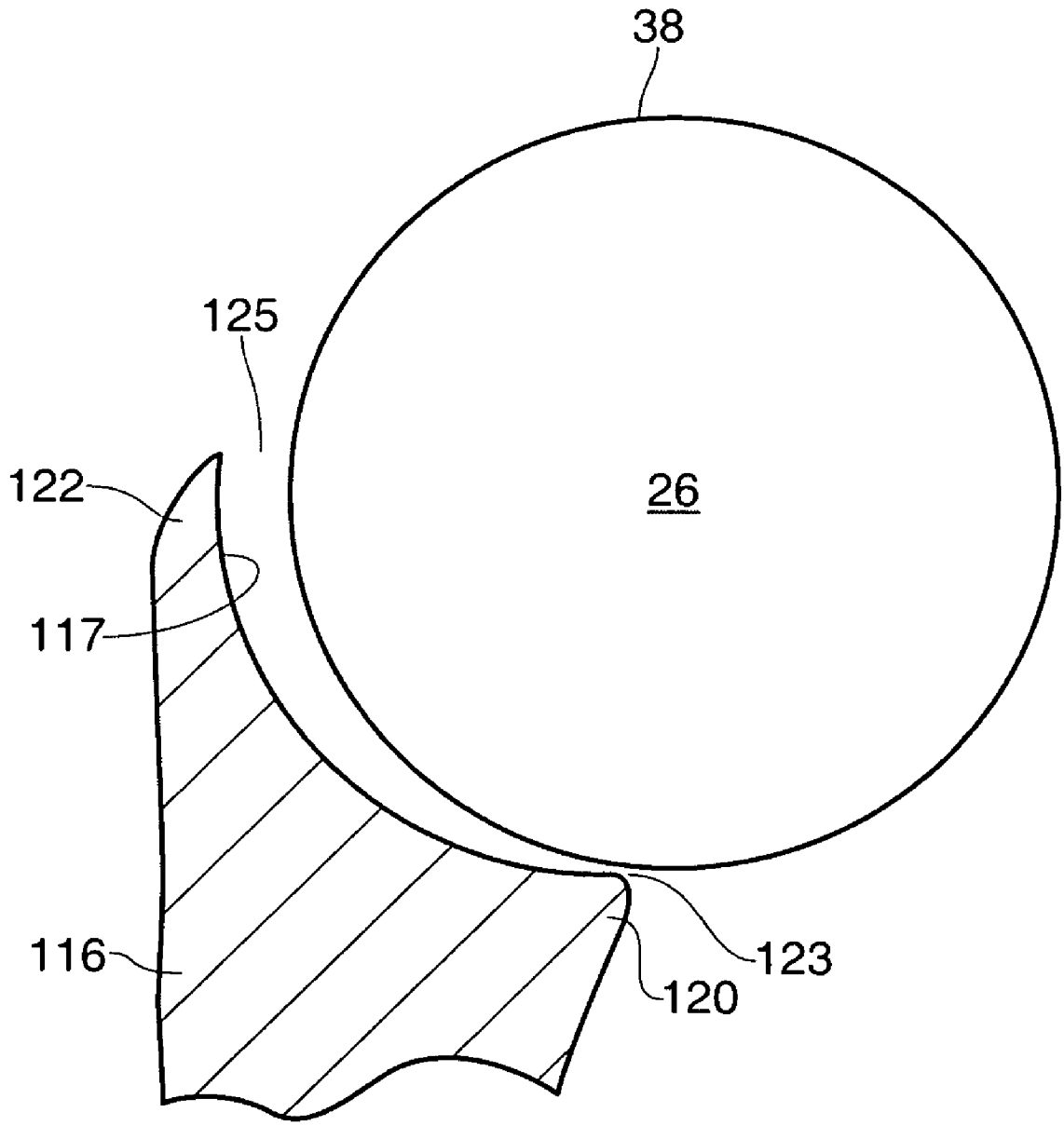
FIG. 3 is a detail diagram of a diverging gap shown in FIG. 2.

FIG. 3 shows a detail diagram of the diverging gap shown in FIG. 2. In FIG. 3, a gap 123 at the leading edge 120 of the electrode 116 and a gap 125 at the trailing edge 123, is shown.

It has been discovered that providing a diverging gap between the surface 117 of the electrode 116 and the surface 38 of the developer roller 26 in the direction of travel of the developer roller 26 relative to the electrode 116 improves the printing that is achieved. Flow streaks are less noticeable. It is possible that this is due to reducing the effect of air bubbles in the toner. Reducing production of flow streaks on the final printed substrate when compared to the prior art parallel gap between the electrode 116 and the developer roller 26 is, of course, desirable.

It has also been discovered that a converging gap does not reduce the production of flow streaks when compared with the prior art parallel gap between the developer roller 26 and the electrode 116—indeed it makes it worse. Whereas the diverging gap does not necessarily completely solve the problem of flow streaks it can significantly reduce the production of flow streaks on the printed substrate. Looked at in one way, some embodiments of the invention can be considered to be ensuring that a converging gap is avoided.

Figure 4:
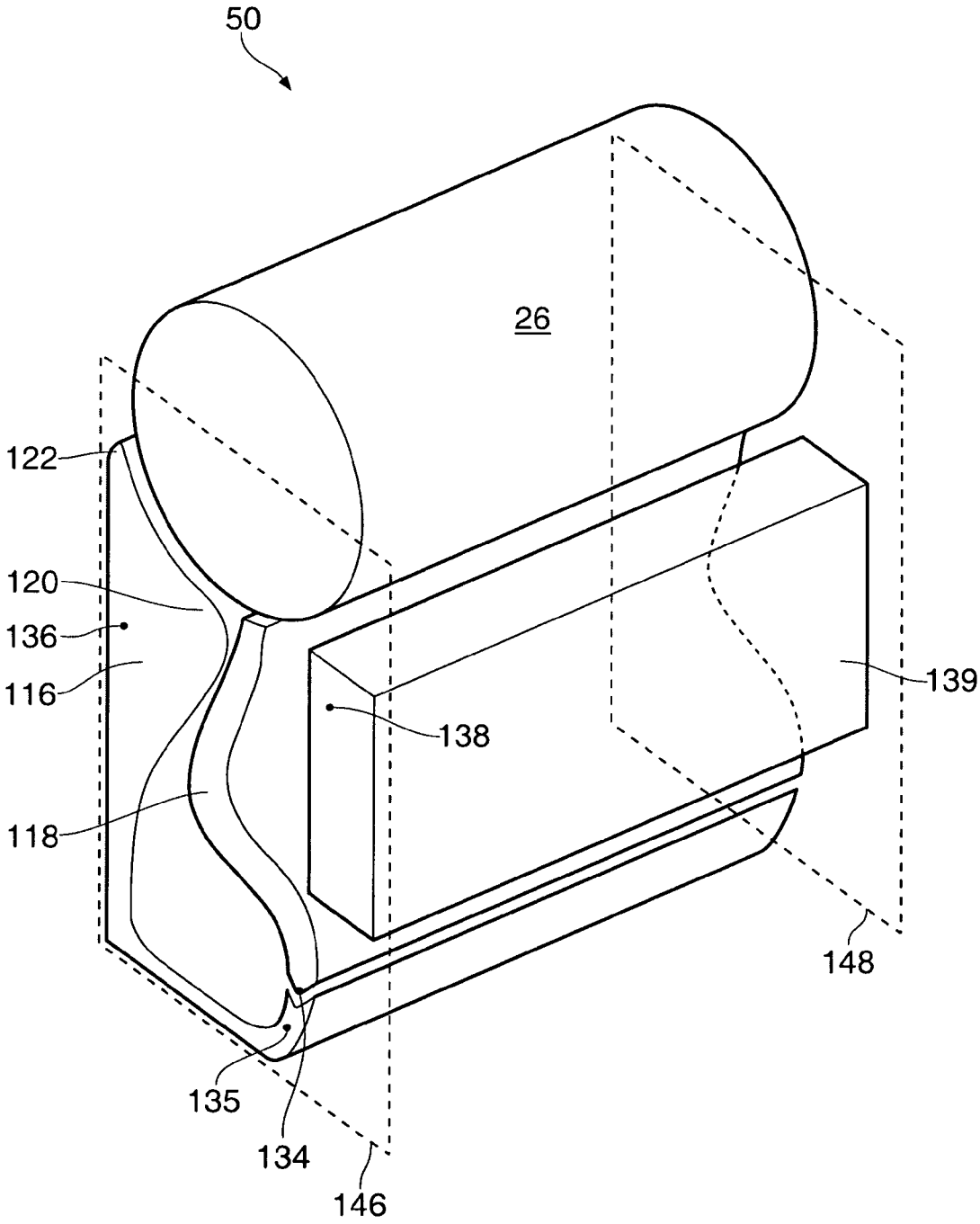
FIG. 4 is a perspective diagram of the developer assembly shown in FIG. 2.

It will be appreciated that to control the dimensions of the gap between the developer roller 26 and the electrode 116 requires fine control of the manufacturing process which can be achieved according to one embodiment of the invention as shown in FIG. 4. This ensures that a divergent gap is deliberately introduced during the manufacturing process. In FIG. 4, the developer assembly 50 has end walls 146, 148 which are not shown in FIG. 2. In FIG. 2 the rollers 124, 126, 130, 132, the electrode 116 and the opposite wall 118 are mounted between these end walls 146, 148. A connecting member 139 is provided between each end wall 146, 148. Two plastic spacers 137 and 138 in each of the electrode 116 and the connecting member 139 insulate the electrode 116 and the connecting member 139 from the housing 102. Two pins 136 and 135 are provided in upper and lower parts of the electrode 116 as seen in FIG. 2. The pins 135, 136 are arranged to engage with the end walls 146, 148 to set the diverging gap 123, 125 prior to fitting the developer assembly 50 into the image developing apparatus 10.

The position of each pin 135, 136 is set during the manufacturing of the developer assembly 50 to set the dimensions of the diverging gap. Setting the position of the pin 136 achieves an offset of the electrode 116 from the roller 26. Setting of the position of the pin 135 sets the distance of the gap along the length of the electrode 116 next to the roller 26. In this manner the electrode is pivotally mounted at an axis defined by pin 136 relative to the roller 26 prior to setting the position of the pin 135. It will be appreciated that to deliberately set the gap so that it is diverging may require an accurate measurement step as part of the manufacturing process. Such a measurement is well known to the skilled person using a co-ordinate measurement machine and will not be described further. It will also be appreciated that the diverging gap from the leading edge 120 of 400 μm to the trailing edge 122 of 550 μm is an optimised gap which has been determined empirically. These dimensions have a tolerance which has been calculated to be 400 μm±40 μm for the leading edge 120 and 550 μm±40 μm for the trailing edge 122 (for a roller of diameter 40 mm i.e. the maximum gap is $0.2\times10^{-2}$% of the diameter and the minimum gap is $0.1\times10^{-2}$% of the diameter). It will be appreciated that different diameter rollers will have substantially the same size gap.

The large difference in voltage between electrode 116 and the developer roller 26 causes toner particles to adhere to developer roller 26, while the generally neutral carrier liquid is generally not affected by the voltage difference. The deposited liquid toner is carried by the surface 38 of the roller 26 in the direction indicated by arrow 114. The layer of liquid toner deposited on the surface 38 is at a concentration of 15-17 percent.

In addition to the developer roller 26 and the electrode 116, assembly 50 includes a squeegee roller 124 and a cleaning roller 126 which are mounted within the housing 102 in contact with the surface of the developer roller 26 as shown in FIG. 2. The rollers 124 and 126 are composed of any suitable electrically conducting material, such as metal, having a smooth surface. The diameters of the squeegee roller 124 and the cleaning roller 126 are significantly smaller than that of developer roller 26. Thus, if the diameter of roller 26 is approximately 4 centimeters, the diameters of rollers 124 and 126 are approximately 16 millimeters and 10 millimeters respectively.

When the image forming apparatus is operated, the rollers 124 and 126 are electrically charged and are caused to rotate in a sense opposite that of the developer roller 26 while being urged against the resilient surface of the roller 26. In one embodiment of the invention, the squeegee roller 124 is charged to a negative voltage of 400-800 Volts, for example approximately −600 Volts, and the cleaning roller 126 is charged to a negative voltage of 0-200 Volts.

The squeegee roller 124 is urged against the developer roller 26, at a pressure of approximately 100 grams per centimeter of length, by means of two leaf springs (not shown), one on each end wall 146, 148.

The squeegee roller 124 is operative to squeegee excess carrier liquid from the surface 38 of the developer roller 26, thereby to further increase the concentration of solids on the surface 38. Due to the squeegee action at the region of contact between the resilient surface 38 and the surface of squeegee roller 124, a large proportion of the carrier liquid contained within the toner concentrate is squeezed out of the layer, leaving a layer having a solids concentration of 20% or more. The excess carrier liquid, which may include a certain amount of toner particles, drains towards toner outlet 106.

The ends of squeegee roller 124 and the developer roller 26 are formed with matching chamfered ends to reduce the effects of end overflow. Such chamfered rollers are described more fully in a PCT application entitled "Squeegee Roller for Imaging Systems" which corresponds to Israeli Patent Application No. 111 441, filed Oct. 28, 1994.

The cleaning roller 126, by virtue of the relatively low voltage to which it is charged, is operative to remove residual toner from the surface 38 of the developer roller 26. The toner collected by the roller 126 is then scraped off the roller 126 by a resilient cleaning blade 128 which is urged against the surface of the roller 126. The scraped toner is absorbed by a sponge roller 130, which is urged against the roller 126 so as to be slightly deformed thereby by approximately 1.5 millimeters radially. The sponge roller 130 rotates in the same sense as that of the cleaning roller 126, such that the surfaces of rollers 126 and 130 move in opposite directions at their region of contact. The sponge roller 130 also absorbs some of the excess liquid toner from the deposition region between the electrode 116 and the developer roller 26, mainly including carrier liquid, which is drained along the external surface of insulator wall 118 of chamber 110. The roller 130 has a diameter of approximately 20 millimeters and is formed of open-cell polyurethane surrounding a metal core having a diameter of approximately 8 millimeters.

Finally, some of the toner particles and carrier liquid absorbed in sponge roller 130 is squeezed out of the sponge roller by a relatively rigid squeezer roller 132, which is urged deeply into the sponge roller 130, desirably approximately 2 millimeters radially. The squeezer roller 132 is an idler roller which rotates in response to the rotation of sponge roller 130.

As the roller 26 continues to rotate and interfaces the developed image-bearing surface of the drum 12, portions of the layer of the liquid toner concentrate are selectively transferred to the surface 16 of the drum 12, thereby developing the electrostatic image as explained above.

After portions of the layer of toner concentrate have been transferred to the surface 16 of the drum 12 to develop the electrostatic image, the remaining portions of the toner layer on the roller 26 continue to rotate on the surface 38 until they reach the region of contact with the cleaning roller 126. As described above, the relative electrical potentials on the roller 26 and the roller 126 cause the remaining portions of the toner layer to be transferred to roller 126. Resilient blade 128, which is anchored to the housing 102, scrapes off the remaining portions of the toner layer from the surface of roller 126, as described above.

Figure 5:
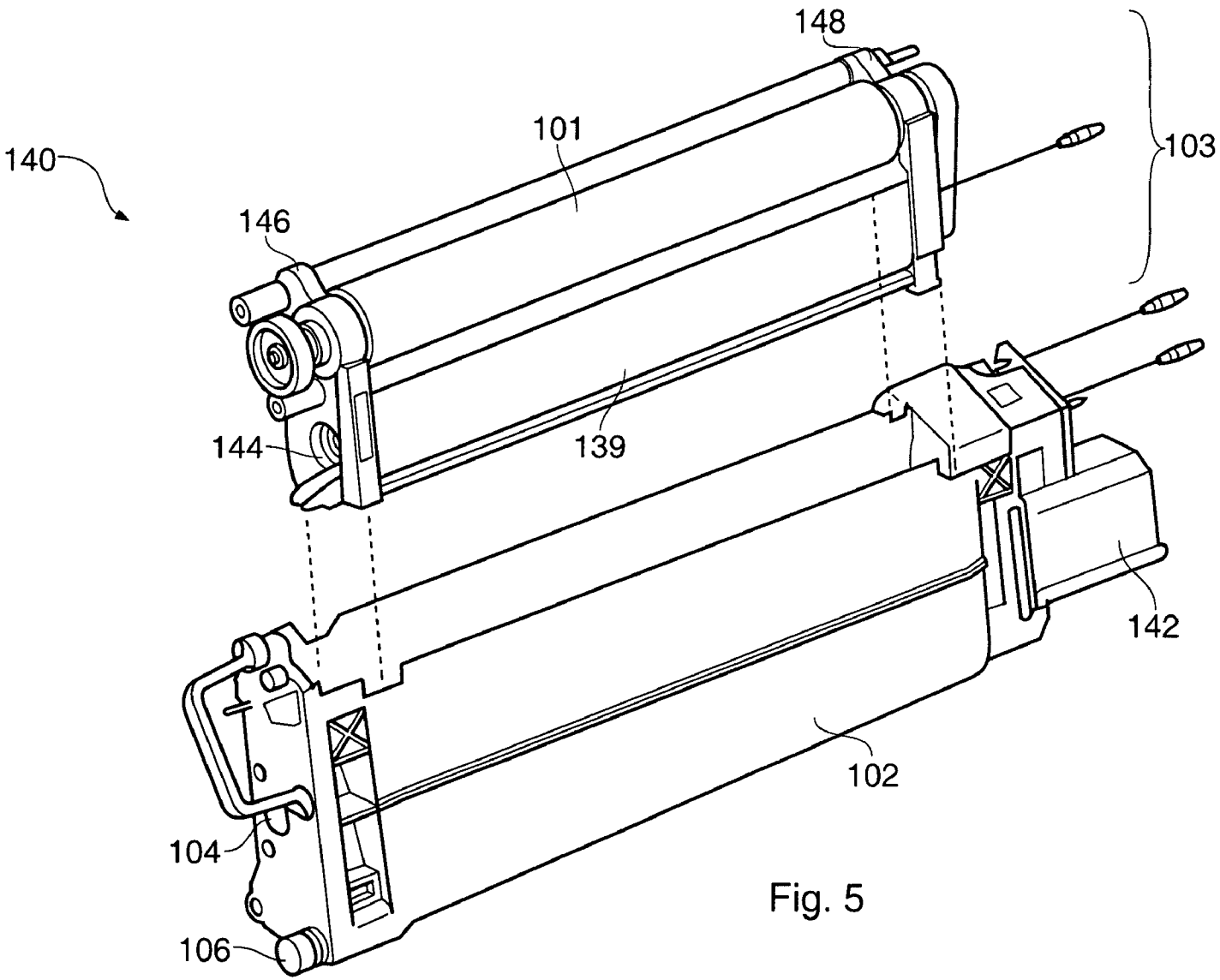
FIG. 5 is an exploded diagram of a developer assembly shown in perspective according to an embodiment of the present invention.

In FIG. 5 there is shown an exploded diagram of a developer assembly, generally designated 140, shown in perspective according to an embodiment of the present invention. Like features to the embodiment of FIG. 2 are shown with like reference numerals. In FIG. 5 the developer assembly 140 is shown as a removable cartridge which is readily insertable into the image forming apparatus 10 should failure of the BID engine 103 occur. In FIG. 5 the developer assembly 140 includes the housing 102 with the removable BID engine 103. A motor 142 for the developer assembly 140 is shown attached to the housing 102 for driving the BID engine 103. The housing 102 includes the toner outlet 106 and the toner inlet 104, the toner inlet 104 cooperating with a BID engine inlet 144 when the BID engine 103 is in situ in the housing 102. Also shown are end walls 146 and 148 of the BID engine 103 which are approximately 320 mm apart. Between the end walls are mounted the rollers 101, 124, 126, 130, 132 the electrode 116, the opposite wall 118 and the connecting member 139. The connecting member 139 may include the spacer 138 shown in FIG. 2 to space the connecting member 139 from the housing 102.

Figure 6:
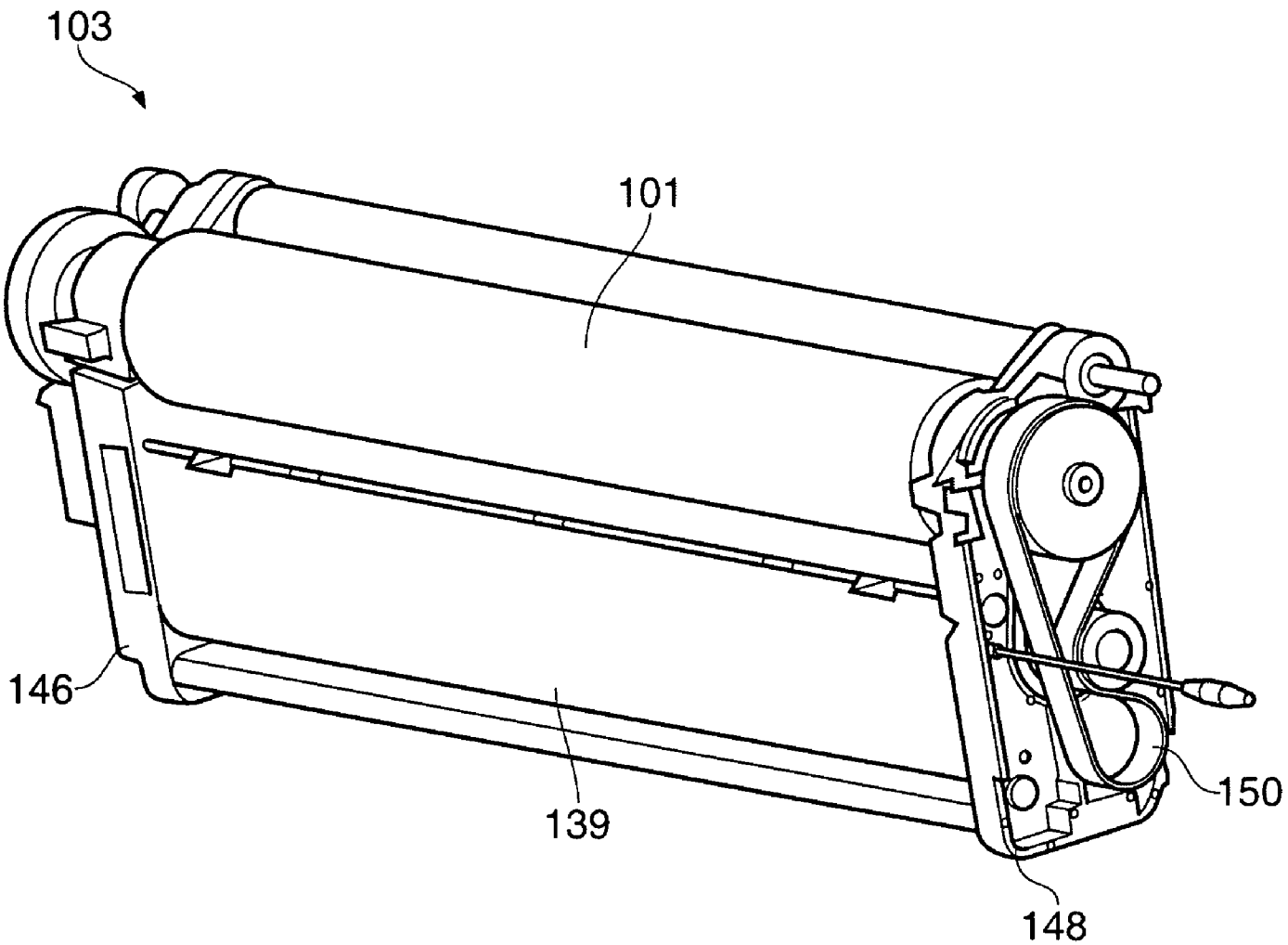
FIG. 6 is a schematic diagram of a part of the developer assembly shown in FIG. 5 according to an embodiment of the present invention.

FIG. 6 is a schematic illustration of a part of the developer assembly shown in FIG. 2 according to an embodiment of the present invention, generally designate 103. FIG. 6 shows a drive belt 150 which is used to operate the BID engine 103.

Figure 7:
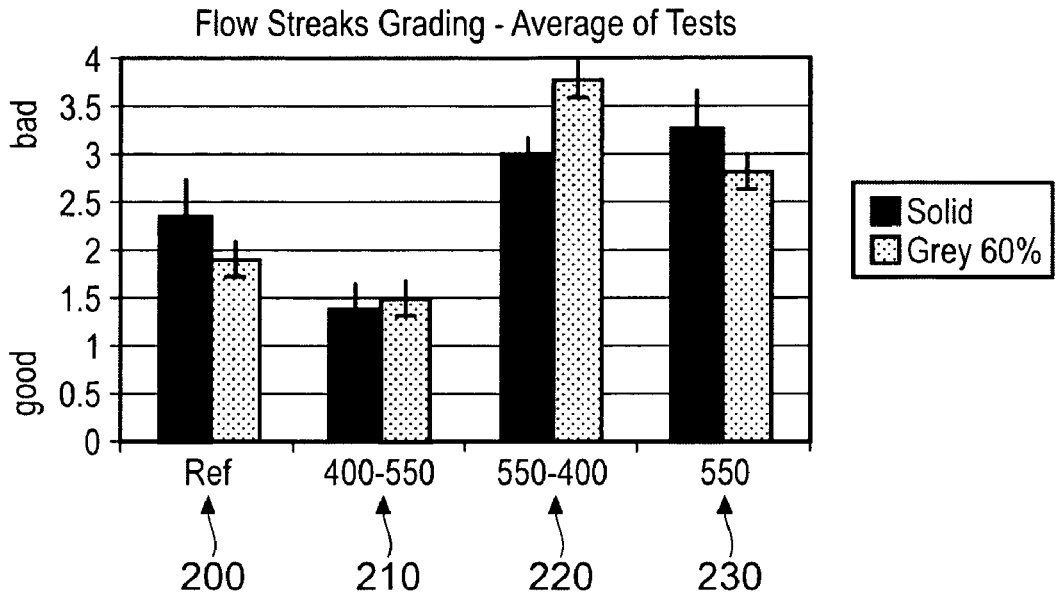
FIGS. 7 and 8 illustrate graphs showing a comparison of flow streaks grading.
Figure 8:
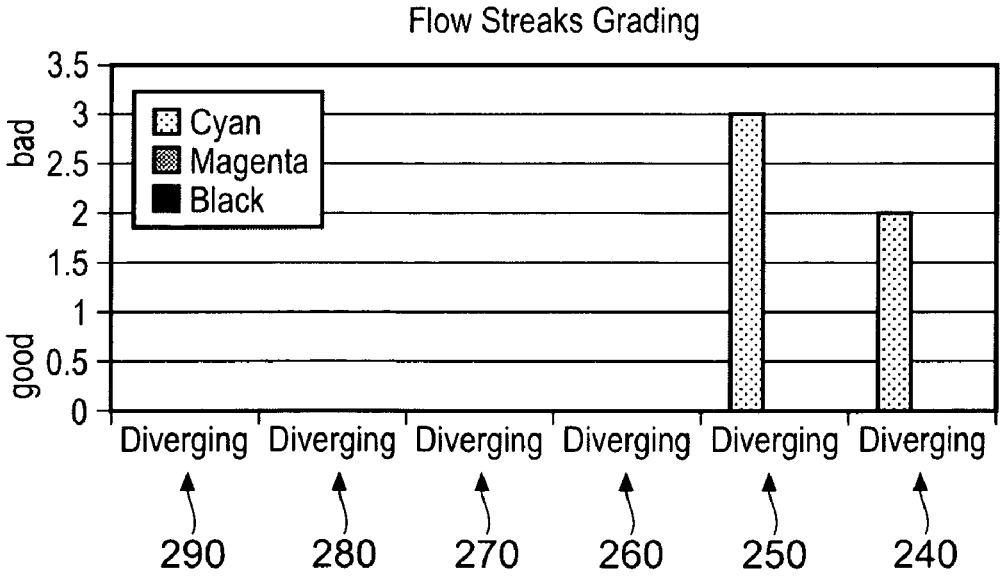

FIGS. 7 and 8 show graphs comparing the grading for severity of streaks printed on a printed page. In FIG. 7, the results from a parallel reference electrode gap (440 μm) are shown at 200 those from a diverging electrode gap (400 to 550 μm) are shown at 210, results from a converging electrode gap (550 to 440 μm) are shown at 220, and results from a parallel reference gap (550 μm) is shown at 230. A flow streak grade 0 means that no flow streaks were seen on printed page. FIG. 7 shows that the diverging gap of 400 to 550 μm provides the least amount of flow streaks.

In FIG. 8 the results of a different experiment are shown where three colours were printed on a page using six developer assemblies. Two of the developer assemblies 240, 250 had reference (parallel) gaps and four of the developer assemblies 260, 270, 280, 290 had diverging gaps. FIG. 8 shows that the developer assemblies 240, 250 for the cyan colour with the reference gap produced a large amount of flow streaks, where as the developer assemblies for the magenta and black colours 260, 270, 280, 290 with the diverging gaps provided no flow streaks.

It will be appreciated by persons skilled in the art that the present invention is not limited to what as been particularly shown and described above. Rather, the scope of the present invention is defined by the claims that follow.

It should be understood that the invention is not limited to the specific type of image forming system used and the present invention is also useful with any suitable imaging system which forms a liquid toner image on an image forming surface, such as that shown in the above referenced patent application Ser. No. 08/371,117 (now U.S. Pat. No. 5,745,829). The specific details given above for the image forming system are included as part of a best mode of carrying out the invention, however, many aspects of the invention are applicable to a wide range of systems as known in the art for electrostatic printing and copying.

The invention claimed is:

1. A toner development unit for an image forming apparatus including a roller and an electrode adjacent thereto, the electrode having an arcuate extent adjacent to a portion of a surface of the roller to define a toner application gap therebetween, the roller being adapted to rotate in a given direction wherein the gap diverges in the direction of rotation of the roller relative to the electrode, the unit further comprising spaced end walls having the roller and the electrode mounted therebetween, the unit having at least one locating device for engaging at least one end wall for setting the dimensions of the diverging gap.

2. A toner development unit according to claim 1 wherein the arcuate extent of the electrode has a leading edge and a trailing edge defined relative to the direction of rotation of the developer roller, and wherein the leading edge is at a distance of approximately 400 μm±400 μm from the surface of the roller.

3. A toner development unit according to claim 2 wherein the trailing edge is at a distance of approximately 550 μm±40 μm from the surface of the roller.

4. A toner development unit according to claim 1 wherein the gap has a leading edge and a trailing edge such that the gap diverges by about 150 μm±50 μm.

5. A toner development unit according to any preceding claim wherein the gap diverges by an amount that is about 1% of the length of the radius of the roller.

6. A toner development unit according to claim 1 wherein the gap between the arcuate extent of the electrode and the surface of the roller diverges linearly.

7. A toner development unit according to claim 1 wherein the gap between the arcuate extent of the electrode and the surface of the roller diverges non-linearly.

8. A toner development unit according to claim 1 wherein the electrode is pivotally mounted relative to the roller.

9. A toner development unit according to claim 1, the development unit also comprising a connecting member between the end walls.

10. An image forming apparatus including a toner development unit according to claim 1.

11. A method of printing including applying toner to a developer drum using a toner development unit having an electrode and a rotatable roller with a divergent gap therebetween, the gap being divergent in the direction of rotation of the roller relative to the electrode, the unit further comprising spaced end walls having the roller and the electrode mounted therebetween, the unit having at least one locating device for engaging at least one end wall for setting the dimensions of the diverging gap.

12. A method according to claim 11 further comprising adjusting the divergent gap to reduce flow streaks on a printed substrate.

13. A method of reducing flow streaks on a substrate using a toner development unit having an electrode and a rotatable roller with a divergent gap therebetween in the direction of rotation of the roller relative to the electrode and spaced end walls having the roller and the electrode mounted therebetween, the unit having at least one locating device for engaging at least one end wall for setting the dimensions of the diverging gap, the method including;

supplying toner to the divergent gap;

transferring toner from the gap to the rotatable roller;

transferring the toner from the rotatable roller to a developer drum; and transferring the toner from the developer drum to the substrate.

14. A method according to claim 13 and further including adjusting the divergent gap to obtain an optimum diverging gap which minimises flow streaks on the substrate.

15. A xerographic printer development unit having divergent gap between an electrode and a rotatable toner transfer roller to ameliorate flow streaks on printed products printed using the printer development unit, the unit comprising spaced end walls having the roller and the electrode mounted therebetween and at least one locating device for engaging at least one end wall for setting the dimensions of the diverging gap.

* * * * *

UNITED STATES PATENT AND TRADEMARK OFFICE

CERTIFICATE OF CORRECTION

PATENT NO. : 7,522,865 B2
APPLICATION NO. : 11/396666
DATED : April 21, 2009
INVENTOR(S) : Guy Hasdai et al.

It is certified that error appears in the above-identified patent and that said Letters Patent is hereby corrected as shown below:

In column 9, line 11, in Claim 2, delete "400 μm±400 μm" and insert -- 400 μm±40 μm --, therefor.

In column 10, line 27, in Claim 15, after "having" insert -- a --.

Signed and Sealed this

Sixth Day of April, 2010

David J. Kappos

David J. Kappos
*Director of the United States Patent and Trademark Office*